US005722597A

United States Patent [19]

Guo

[11] Patent Number: 5,722,597

[45] Date of Patent: Mar. 3, 1998

[54] SPRAY NOZZLE

[76] Inventor: Wen-Li Guo, No. 10, Fang Dong Road, Wen Gin Tsuen, Fang Yuan Hsiang, Chang Hua Hsien, Taiwan

[21] Appl. No.: 630,340

[22] Filed: Apr. 10, 1996

[51] Int. Cl.[6] ..... A62C 31/02

[52] U.S. Cl. ..... 239/395; 239/446

[58] Field of Search ..... 239/390, 391, 239/392, 393, 395, 436, 443, 444, 446, 530, 548, 561

[56] References Cited

U.S. PATENT DOCUMENTS 586,955 7/1897 Askins ..... 239/446

924,867 6/1909 Winfield et al. ..... 239/446

3,392,920 7/1968 Gagliardo ..... 239/446

*Primary Examiner*—Andres Kashnikow

*Assistant Examiner*—Steven J. Ganey

*Attorney, Agent, or Firm*—Charles E. Baxley, Esq.

[57] ABSTRACT

A spray nozzle includes a casing having a chamber for receiving water and having a side passage and a middle passage formed in an extension. A valve is rotatably supported in the casing and has an upper notch for aligning with the side passage and has a lower notch for aligning with the middle passage. A housing and a head are rotatably secured to the casing. The head has one or more annual walls for aligning with the middle passage. The valve may be rotated to align either the upper or the lower notch with the respective passages so as to select a different outlet pattern.

6 Claims, 3 Drawing Sheets

SPRAY NOZZLE

BACKGROUND OF THE INVENTION

1. Field of the Invention

The present invention relates to a nozzle, and more particularly to a multiple pattern spray nozzle.

2. Description of the Prior Art

Typical spray nozzles comprise a control barrel rotatably secured to a head and having a number of outlets selectively engaged with a water passage of the head so as to form different spray water outlet patterns. One type of the spray nozzles is disclosed in U.S. Pat. No. 4,666,085 to Liaw. However, it will be difficult to accurately align either of the outlets with the water passage of the head.

The present invention has arisen to mitigate and/or obviate the afore-described disadvantages of the conventional water spray nozzles.

SUMMARY OF THE INVENTION

The primary objective of the present invention is to provide a spray nozzle having a configuration for effectively controlling the water outlets.

In accordance with one aspect of the invention, there is provided a spray nozzle comprising a casing including a chamber formed therein and including an inlet for connecting the chamber to a water reservoir, the casing including an extension extended therefrom and having at least one first passage and a second passage formed therein and communicating with the chamber, a block rotatably supported in the casing, a valve secured to the block and including at least one first notch formed therein for aligning with the first passage and including a second notch for aligning with the second passage, and means for rotating the block so as to align the first and the second notches with the first and the second passages respectively.

A plug is secured to the extension, the plug includes at least one first opening for aligning with the first passage and includes a second opening for aligning with the second passage, a housing includes a rear portion rotatably secured to the casing at a pivot shaft and includes a front portion, a head is secured to the front portion of the housing and includes at least two annular walls formed therein, and an aligning means may align the second opening of the plug to at least one of the annular walls.

The casing includes a pair of apertures formed therein, the block includes a pair of studs rotatably engaged in the apertures so as to be rotated relative to the casing about the studs, at least one of the studs includes an engaging hole formed therein, the rotating means includes a knob having a protrusion extended therefrom and engaging with the engaging hole so as to rotate the block and the valve.

The valve includes a flat surface formed therein for aligning with the first and the second passages so as to block the first and the second passages.

The extension of the casing includes at least one holder formed therein, the housing includes at least one rib formed therein and having at least two bulges formed therein for engaging with the holders so as to align the second opening with at least one of the annular walls.

The head includes a peripheral portion having a plurality of holes formed therein and includes a middle portion having at least two cavities formed therein, the head includes a board, the annular walls are secured on the board and engaged with the cavities for selectively aligning with the second opening, the board includes at least one groove for aligning with the first opening and for communicating with the holes.

The extension includes at least one channel formed therein and includes at least one projection formed thereon, the housing includes at least one rail slidably engaged with the channel and includes at least one slot formed therein for engaging with the projection so as to limit a rotational movement of the housing relative to the casing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
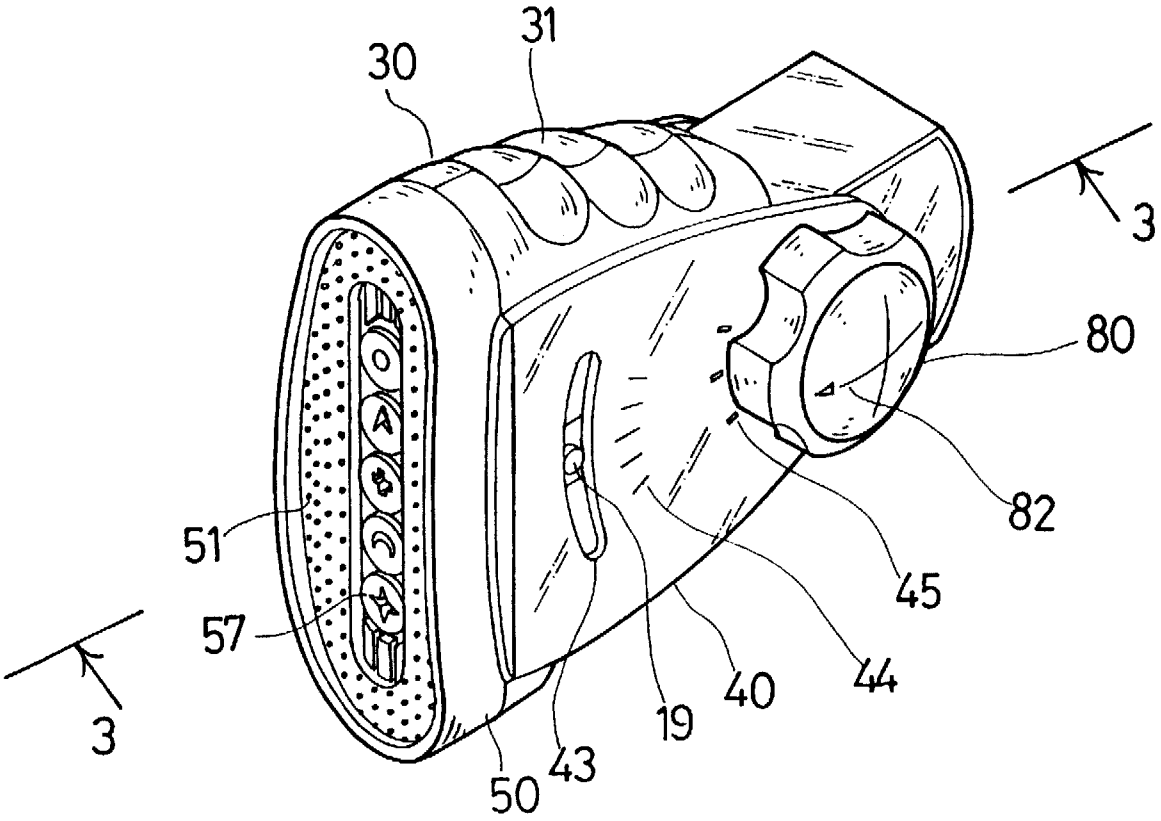
FIG. 1 is a perspective view of a spray nozzle in accordance with the present invention.
Figure 2:
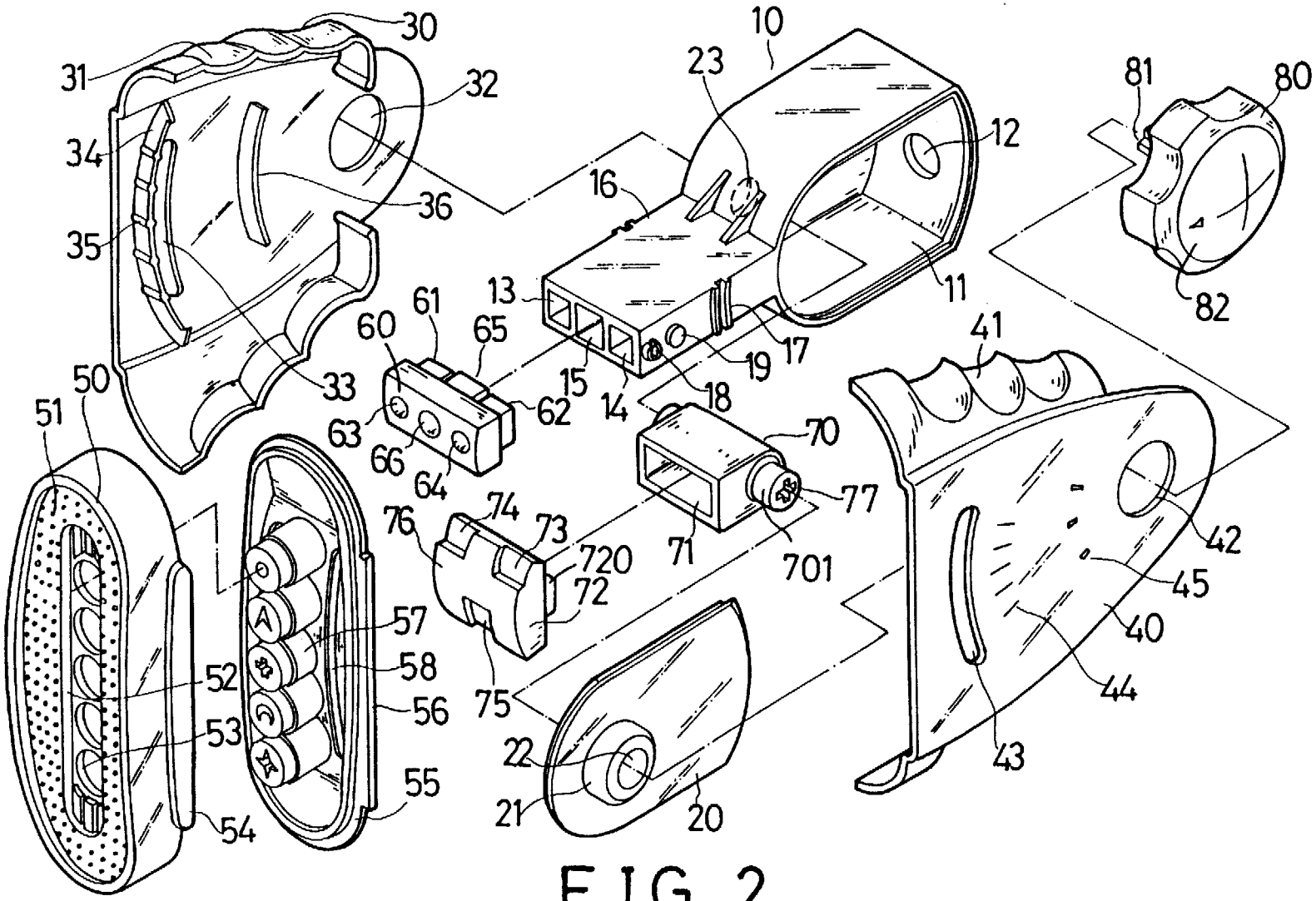
FIG. 2 is an exploded view of the spray nozzle.
Figure 3:
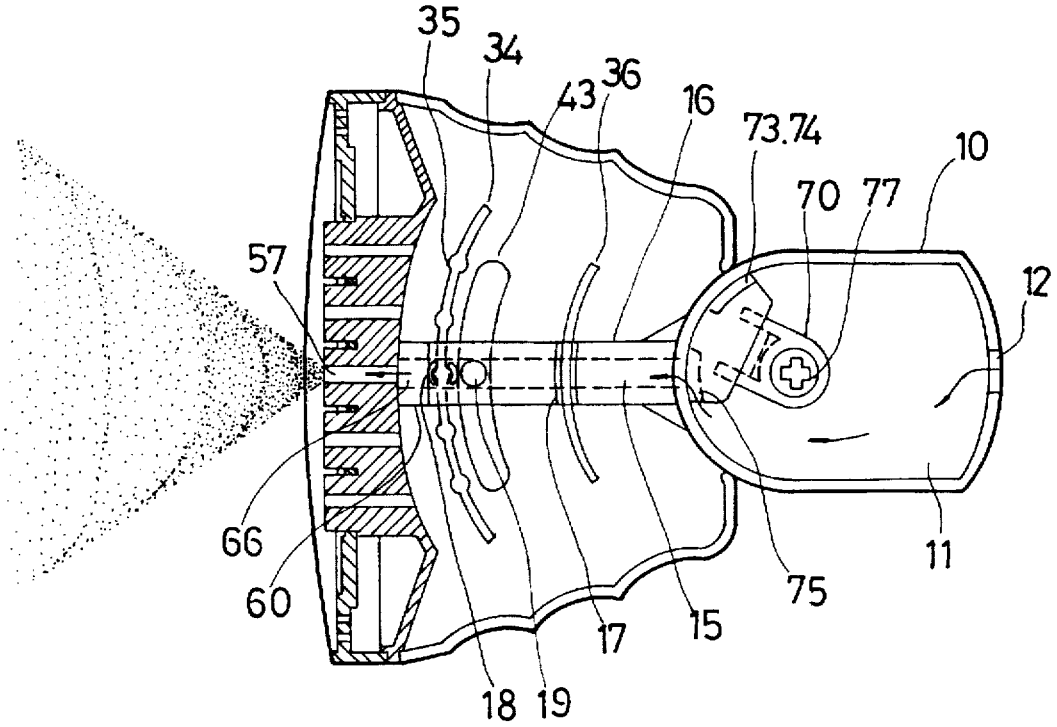
FIGS. 3 and 4 are cross sectional views illustrating the operation of the spray nozzle.

Referring to the drawings, and initially to FIGS. 1 to 3, a spray nozzle in accordance with the present invention comprises a casing 10 having a chamber 11 formed therein and having an inlet 12 for connecting the chamber 11 to a water reservoir. The casing 10 includes a cap 20 secured to one side portion thereof and includes a pair of pivot shafts 21 each having an aperture 22, 23 formed therein. The casing 10 includes an extension 16 extended therefrom and having two side passages 13, 14 and a middle passage 15 formed therein and communicating with the chamber 11. The extension 16 includes a pair of channels 17 and holders 18 and projections 19 formed in the side portions respectively. A block 70 includes a pair of studs 701 extended therefrom and rotatably engaged in the apertures 22, 23 of the casing 10 such that the block 70 is rotatable about the studs 701. The block 70 includes a recess 71 formed therein. A valve 72 includes a projection 720 for securing to the recess 71 of the block 70 and includes two notches 73, 74 formed in the upper portion for aligning with the side passages 13, 14 respectively (FIG. 4), and includes another notch 75 formed in the lower portion for aligning with the middle passage 15 (FIG. 3), and includes a flat middle portion 76 for blocking the passages 13, 14, 15. One of the studs 701 includes an engaging hole 77 formed therein for engaging with a protrusion 81 of a knob 80 so as to be rotated by the knob 80. The knob 80 includes an arrow 82 provided thereon.

A pair of plates 30, 40 may be secured together so as to form a housing. The plates 30, 40 each includes an orifice 32, 42 formed in the rear portion for rotatably engaging with the pivot shafts 21 of the casing 10 and each includes a number of depressions 31, 41 formed therein for facilitating the gripping of the spray nozzle. The plates 30, 40 each includes a rail 36 slidably engaged with the channels 17 and each includes a slot 33, 43 formed in the front portion for engaging with the projections 19 so as to limit the rotational movement of the plates 30, 40 relative to the casing 10. The plates 30, 40 each includes a rib 34 formed therein and having five bulges 35 formed therein for engaging with the holders 18 respectively so as to maintain the plates 30, 40 relative to the casing 10. The plate 40 includes a graduation 44 formed therein for aligning with the projection 19 so as to indicate the relative position between the plates 30, 40 and the casing 10, and includes another graduation 45 formed therein for aligning with the arrow 82 so as to indicate the relative position between the valve 72 and the passages 13, 14, 15. A plug 60 includes three tubes 61, 62, 65 for securing to the passages 13, 14, 15 respectively and includes three openings 63, 64, 66 for communicating with the passages 13, 14, 15 respectively.

A head 50 includes a number of holes 51 formed in the peripheral portion thereof and includes a middle portion 52 having five cavities 53 formed therein and includes a pair of holders 54 formed in the side portions. A board 55 includes a pair of flanges 56 for engaging with the holders 54 so as to be secured to the head 50 and includes five annular walls 57 for engaging with the cavities 53 and for selectively aligning with the middle opening 66; and includes a pair of grooves 58 for aligning with the openings 63, 64 and for communicating with the holes 51. The annular walls 57 each includes a different outlet pattern. The head 50 may be secured to the plates 30, 40 and the plates 30, 40 may be secured together by ultrasonic welding processes.

Figure 4:
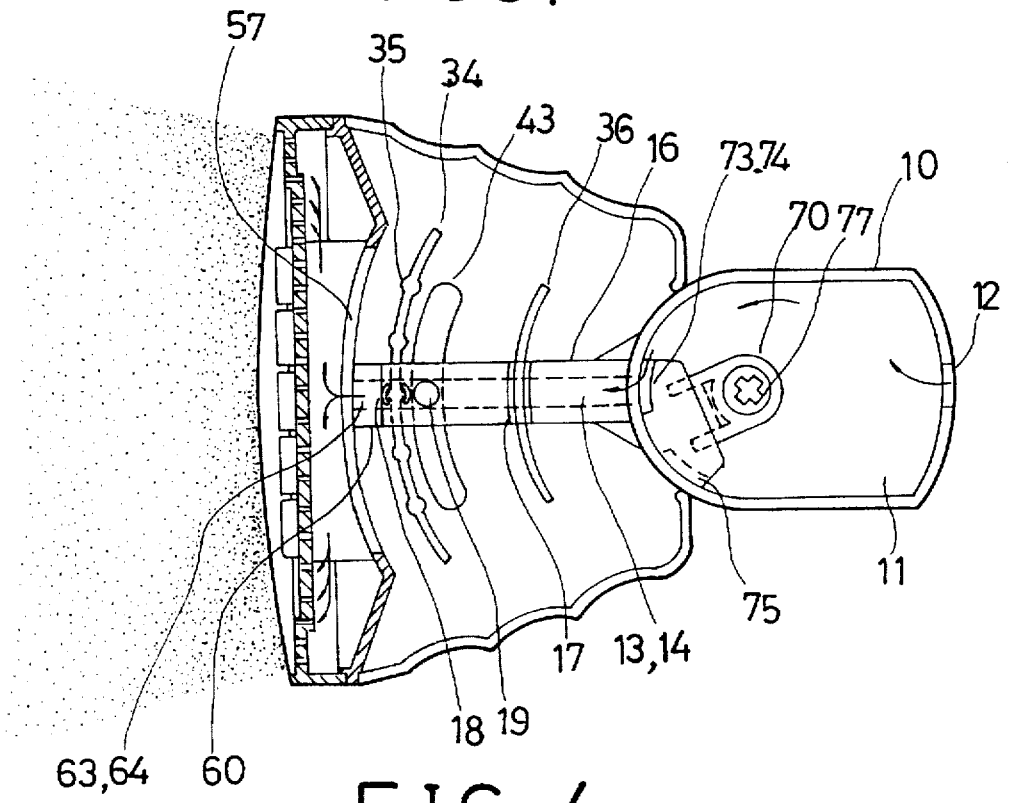

In operation, as shown in FIGS. 2 to 4, when the block 70 and the valve 72 are rotated by the knob 80, the notches 73, 74 may be aligned with the passages 13, 14 (FIG. 4) such that the water contained in the chamber 11 may flow into the passages 13, 14 via the notches 73, 74 and such that the water may flow out of the spray nozzle via the openings 63, 64 and the grooves 58 and the holes 51. As shown in FIG. 3, when the valve 72 is rotated to align the notch 75 with the passage 15, water is allowed to flow into the passage 15 and the opening 66 via the notch 75 and to flow out of the head 50 via either of the annular walls 57. The passages 13–15 may be blocked when the middle portion 76 of the valve 72 is aligned with the passages 13–15. The plates 30, 40 may be rotated about the pivot shafts 21 so as to align either of the annular walls 57 with the opening 66. Either of the bulges 35 may be engaged with the holder 18 so as to stably position the plates 30, 40 relative to the casing 10. The aligning of the arrow 82 of the knob 80 with the graduation 45 may indicate that either the notches 73, 74 or the middle portion 76 or the notch 75 is aligned with the respective passages 63, 64, 66. The aligning of the projection 19 with the graduation 44 may indicate that the opening 66 is aligned with either of the annual walls 57.

Accordingly, the spray nozzle in accordance with the present invention includes a configuration that may be effectively controlled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A spray nozzle comprising:

a casing including a chamber formed therein and including an inlet for connecting said chamber to a water reservoir, said casing including an extension extended therefrom and having at least one first passage and a second passage formed therein and communicating with said chamber, a plug secured to said extension, said plug including at least one first opening for aligning with said first passage and including a second opening for aligning with said second passage, a housing including a rear portion rotatably secured to said casing at a pivot shaft and including a front portion, a head secured to said front portion of said housing and including at least two annular walls formed therein, means for aligning said second opening of said plug to at least one of said annular walls, a block rotatably supported in said casing, a valve secured to said block and including at least one first notch formed therein for aligning with said first passage and including a second notch for aligning with said second passage, and means for rotating said block so as to selectively align said first and said second notches with said first and said second passages respectively.

2. A spray nozzle according to claim 1, wherein said casing includes a pair of apertures formed therein, said block includes a pair of studs rotatably engaged in said apertures so as to be rotated relative to said casing about said studs, at least one of said studs includes an engaging hole formed therein, said rotating means includes a knob having a protrusion extended therefrom and engaging with said engaging hole so as to rotate said block and said valve.

3. A spray nozzle according to claim 1, wherein said valve includes a flat surface formed therein for aligning with said first and said second passages so as to block said first and said second passages.

4. A spray nozzle according to claim 1, wherein said extension of said casing includes at least one holder formed therein, said housing includes at least one rib formed therein and having at least two bulges formed therein for engaging with said holders so as to align said second opening with at least one of said annular walls.

5. A spray nozzle according to claim 1, wherein said head includes a peripheral portion having a plurality of holes formed therein and includes a middle portion having at least two cavities formed therein, said head includes a board, said annular walls are secured on said board and engaged with said cavities for selectively aligning with said second opening, said board includes at least one groove for aligning with said first opening and for communicating with said holes.

6. A spray nozzle according to claim 1, wherein said extension includes at least one channel formed therein and includes at least one projection formed thereon, said housing includes at least one rail slidably engaged with said channel and includes at least one slot formed therein for engaging with said projection so as to limit a rotational movement of said housing relative to said casing.

* * * * *